United States Patent [19]

Theurer et al.

[11] 4,450,771

[45] May 29, 1984

[54] MOBILE BALLAST CLEANING MACHINE

[75] Inventors: Josef Theurer, Vienna; Karl Fölser, Linz, both of Austria

[73] Assignee: Franz Plasser Bahnbaumaschinen-Industriegesellschaft m.b.H., Vienna, Austria

[21] Appl. No.: 343,527

[22] Filed: Jan. 29, 1982

[30] Foreign Application Priority Data

Mar. 4, 1981 [AT] Austria ..... 1006/81

[51] Int. Cl.[3] ..... E01B 27/10

[52] U.S. Cl. ..... 104/1 R; 37/104; 104/2; 171/16; 414/501; 414/542

[58] Field of Search ..... 104/1 R, 2, 5, 6; 171/16; 37/104; 404/99; 414/501, 542

[56] References Cited

U.S. PATENT DOCUMENTS

| | | | |
|---|---|---|---|
| 1,058,915 | 4/1913 | Simpson | 104/6 |
| 3,685,456 | 8/1972 | Plasser et al. | 104/2 |
| 4,152,989 | 5/1979 | Theurer et al. | 104/2 |
| 4,168,130 | 9/1979 | Barth et al. | 404/99 |
| 4,307,667 | 12/1981 | Scheuchzer et al. | 104/2 |

FOREIGN PATENT DOCUMENTS

| | | | |
|---|---|---|---|
| 307476 | 5/1973 | Austria . | |
| 424261 | 1/1926 | Fed. Rep. of Germany | 104/5 |
| 557177 | 2/1957 | Italy | 404/99 |
| 612991 | 6/1978 | U.S.S.R. | 404/99 |

*Primary Examiner*—Randolph Reese

*Attorney, Agent, or Firm*—Kurt Kelman

[57] ABSTRACT

A mobile ballast cleaning machine comprising a frame mounted on two undercarriages for mobility along a track supported on the ballast resting on a subgrade, a ballast excavating means mounted on the frame between the track to expose the subgrade, a ballast screening means arranged on the frame to receive the removed ballast from the ballast excavating means and to discharge cleaned ballast and waste, conveyor band means for carrying away the waste and for redistributing the cleaned ballast, the ballast redistributing conveyor band means having a discharge end and a zone being defined between the ballast excavating means and the discharge end for laying a succession of rigid foam plates on the exposed subgrade, and apparatus for handling the rigid foam plates, the apparatus including a plate receiving and transfer station, an elongated plate conveying path extending from the station to the zone and a plate turning and laying mechanism receiving successive ones of the rigid foam plates from the conveying path and for laying the successive plates in said zone under the track in a position extending transversely to the track.

9 Claims, 5 Drawing Figures

MOBILE BALLAST CLEANING MACHINE

The present invention relates to a mobile ballast cleaning machine comprising a frame mounted on two undercarriages for mobility along a track supported on the ballast resting on a subgrade, a ballast excavating means mounted on the frame between the two undercarriages for removing ballast from under the track to expose the subgrade, a ballast screening means arranged on the frame to receive the removed ballast from the ballast excavating means and to discharge cleaned ballast and waste, and conveyor band means for carrying away the waste and for redistributing the cleaned ballast, the ballast redistributing conveyor band means having a discharge end and a zone being defined between the ballast excavating means and the discharge end for laying a succession of rigid foam plates on the exposed subgrade.

Austrian patent No. 307,476, of Sept. 15, 1972, discloses a mobile ballast cleaning machine equipped with apparatus for inserting a protective layer between the subgrade and the ballast resting thereon. This apparatus comprises a bogie arranged between the ballast excavating means and the discharge end of the ballast redistributing conveyor band means, the bogie running on its own wheels on the track and being coupled to the machine frame by a connecting rod. A roller storing a roll of synthetic resin film is vertically and laterally adjustably mounted on the bogie and extends under the track and transversely thereto. The width of the roller and film corresponds substantially to that of the exposed subgrade under the track. The bogie also carries a smoothing roll preceding the film storing roller and engaging the exposed subgrade as well as a welding device for welding together overlapping ends of successive film sections. The stored film is automatically unreeled from the roller as the machine continuously advances along the track. In this way, a continuous separating layer is formed during the ballast cleaning operation between the subgrade and the ballast to inhibit liquid from being transferred therebetween, enables rain or other water to be drained from the ballast bed and thus prevents damage to the track bed.

It has also been proposed manually to insert from the side rigid synthetic resin foam plates in a zone from which ballast has been removed during a ballast cleaning operation, either directly on the exposed subgrade or on a sand layer applied thereto. Such plates made, for example, of polystyrene or polyurethane foam of readily attainable density and elasticity function well as a heat and water barrier protective layer. Furthermore, if the plates have a certain mimimum gage, they serve to distribute the weight of the track and ballast as well as the dynamic loads resulting from passing trains uniformly over the area of the subgrade without the ballast substantially changing or damaging the inner structure of the foam plates whereon it rests. However, while the use of such protective foam plates is quite advantageous for the quality of the track bed, the manual placing of such plates has not been practical, partially because of the construction of ballast cleaning machines and particularly because an accurate laying of the plates in abutting relationship and a proper coordination of the ballast cleaning and plate laying operations have been impossible.

It is the primary object of this invention to provide a mobile ballast cleaning machine of the first described type and which enables rigid foam plates to be laid quickly, dependably and accurately in the course of the ballast cleaning operation.

The above and other objects are accomplished in accordance with the invention with an apparatus for handling the rigid foam plates, the apparatus including a plate receiving and transfer station, an elongated plate conveying path extending from the station to the zone defined between the ballast excavating means and the discharge end of the ballast redistributing conveyor band means for laying a succession of rigid foam plates on the exposed subgrade, and a plate turning and laying mechanism receiving successive ones of the rigid foam plates from the conveying path and for laying the successive plates in this zone under the track in a position extending transversely to the track.

A mobile ballast cleaning machine equipped with this apparatus assures a rapid, accurate and effective laying of the rigid foam plates in coordination with the ballast cleaning operation. The plate laying operation can be coordinated precisely with the normal operation and advancement of the mobile ballast cleaning machine so that the machine will operate well without any interference between the ballast cleaning and plate laying operations. Furthermore, the automatic laying of the foam plates assures much higher accuracy than is obtainable by hand and eliminates any danger to operating personnel being present in the range of the track on which the machine moves continuously, all operations of the machine being monitored and controlled from a cab on the machine itself. Finally, this machine considerably increases the speed of the plate laying operation in coordination with the ballast cleaning operation so that it can be used during relatively short intervals between passing trains.

The above and other objects, advantages and features of the present invention will become more apparent from the following detailed description of certain now preferred embodiments thereof, taken in conjunction with the accompanying schematic drawing wherein FIG. 1 is a side elevational view of one embodiment of a mobile ballast cleaning machine according to this invention;

Figures 1, 2, 3, 4:
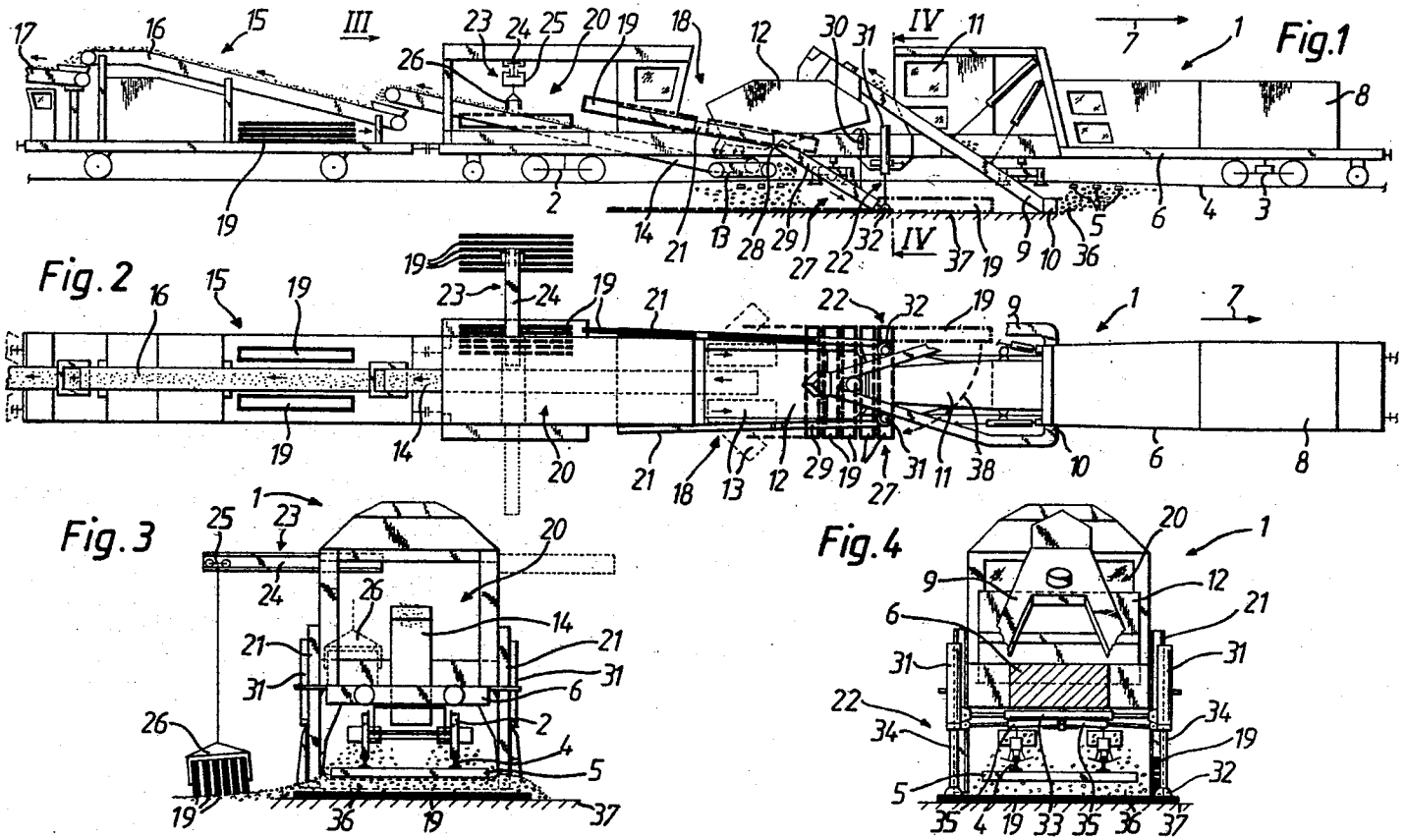
FIG. 2 is a diagrammatic top view thereof.
FIG. 3 is an enlarged end view of the plate receiving and transfer station of the plate handling apparatus, seen in the direction of arrow III of FIG. 1.
FIG. 4 is a sectional view along line IV—IV of FIG. 1 in the zone defined between the ballast excavating means and the discharge end for laying a succession of rigid foam plates on the exposed subgrade.

Referring now to the drawing and first to the embodiment of FIGS. 1 to 4, there is shown mobile ballast cleaning machine 1 comprising frame 6 mounted on two undercarriages 2, 3 constituted by swivel trucks and auxiliary undercarriages for mobility along a track consisting of rails 4 fastened to ties 5 supported on ballast 36 resting on subgrade 37. During the ballast cleaning operation, the machine advances in an operating direction indicated by arrow 7. The front end of machine frame 6 carries housing 8 for the power plant of the machine. As is conventional, the machine is equipped with a track lifting unit and ballast excavating means 9 mounted on the frame between undercarriages 2 and 3 for removing ballast from under the track to expose subgrade 37. The conventional ballast excavating means comprises an endless ballast excavating chain moving in a polygonal path circumscribing a space and transverse course 10 of the ballast excavating chain runs transversely under the track, hydraulic drives linking the chain to the frame for laterally and vertically positioning the chain. Observation cab 11 is arranged on the machine frame within the space circumscribed by the polygonal path of the ballast excavating chain. This location of the cab is spatially and functionally very advantageous and if the cab is encased by a glass wall providing a 360° view, an operator in the cab can monitor not only the plate laying but also the ballast removing operation. The machine further comprises ballast screening means 12 arranged on frame 6 to receive the removed ballast from ballast excavating means 9, 10 and to discharge cleaned ballast and waste. In addition, the machine comprises conveyor band means 13, 14 for carrying away waste and for redistributing the cleaned ballast, ballast redistributing conveyor band means 13 having a discharge end and zone 27 being defined between the ballast excavating means and the discharge end for laying a succession of rigid foam plates 19 on exposed subgrade 37. Conveyor band means 13 is comprised of laterally pivotal endless conveyor bands (see FIG. 2) for distributing cleaned ballast over the entire width of the ballast bed upon pivoting of the conveyor bands while the conveyor bands convey cleaned ballast deposited thereon from the ballast screening means in the direction indicated by the small arrows shown on the conveyor bands which are shown in broken lines in FIG. 2. Conveyor band means 14 carrying away the waste discharged through ports in the bottom of screening means 12 is constituted by an elongated, centrally positioned conveyor band extending through plate receiving and transfer station 20 of the apparatus 18 for handling rigid foam plates 19 to a rear end of machine frame 6. This saves space and provides an optimal operation of the waste disposal.

Freight car 15, which may be equipped with its own drive, is coupled to machine 1 and carries elongated conveyor band 16 receiving the waste from conveyor band means 14 and further transporting the waste away from the ballast cleaning machine, faster moving conveyor band 17 receiving the waste from conveyor band 16. This fast-moving conveyor band is laterally pivotal to throw the waste onto the shoulders when the conveyor band is laterally outwardly pivoted or to throw it into container cars coupled to freight car 15 for storing the waste.

According to the invention, ballast cleaning machine 1 comprises plate handling apparatus 18 for conveying and laying rigid foam plates 19 in zone 17 to provide insulation between subgrade 37 and the cleaned ballast deposited thereon from the discharge end of conveyor bands 13. The preferably polyurethane foam plates are of rectangular elongated shape and their length corresponds substantially to the width of the exposed subgrade.

Apparatus 18 includes plate receiving and transfer station 20, elongated plate conveying path 21, 21 extending from station 20 to zone 27 and plate turning and laying mechanism 22 receiving successive ones of rigid foam plates 19 from the conveying path and for laying the successive plates in zone 27 under the track in a position extending transversely to the track. The illustrated elongated plate conveying path is shown to comprise inclined chutes 21, 21 having an inlet receiving successive ones of rigid foam plates 19 from receiving and transfer station 20. The chutes are arranged laterally outside frame 6 for glidingly guiding the successive plates down to zone 27. The illustrated chutes are arranged to receive and glidingly guide the rigid foam plates upright. This preferred structure has the advantage that such conveying chutes may be installed subsequently on almost all existing ballast cleaning machines and convey the plates by gravity into the laying zone without requiring any conveying power.

As shown in the drawing, a roof is placed above plate receiving and transfer station 20 which is arranged at a rear end of frame 6, and this station includes plate gripping and hoisting device 23 laterally displaceable with respect to the frame for receiving, gripping and hoisting rigid foam plates 19 stored laterally adjacent the track, for instance in bundles or stacked along the track shoulder. The length of device 23 preferably corresponds to the entire width of the ballast bed. This equipment allows receiving and transfer station 20 to be continuously supplied with plates in a very simple manner, the storing of the plates alongside the track being effectuated during the night, for example, when there is little train traffic and this work interferes minimally with such traffic.

In the illustrated embodiment, plate gripping and hoisting device 23 is comprised of double-T carrier beam 24 displaceable to either side of machine frame 6 to project to the track shoulder and serving as a rail for trolley or traveling winch 25 supporting vertically movable plate gripping element 26. As indicated in FIG. 2, operation of device 23 enables stacks of plates 19 to be gripped and hoisted for movement to plate receiving and transfer station 20 where the plates are placed on the bottom of the station and then successively inserted manually into inclined chutes 21 for conveyance to zone 27. Each plate guide chute 21 has a lower chute section 29 pivotal about a horizontal axis by drive 30 linking the lower chute section to machine frame 6. Operation of cylinder-piston drive 30 enables the inclination of chute section 29 to be adjusted so that the point of placing plate 19 in zone 27 may be accordingly changed.

As best shown in FIG. 4, plate turning and laying mechanism 22 preceding elongated plate conveying path 21 comprises gripping element 32 capable of gripping a respective one of successive rigid foam plates 19, the gripping element being pivotal about a vertical axis, and drive means 31 for vertically and laterally adjusting the gripping element. The illustrated structure consists of two vertically extending cylinder-piston drives 31 arranged opposite each other at each side of machine frame 6 and carrying plate gripping suction head 32 at the lower ends of their piston rods 34 for gripping a respective end of each plate 19. The two drives may be laterally adjusted by adjusting drive 33 extending transversely to frame 6. In addition, pivoting drive 35 is connected to piston rod 34 of each vertical drive 31 so that the piston rod may be turned about its own axis over an angle of at least 90°.

This relatively simple but dependable plate turning and laying structure assures an accurate and abutting positioning of successive rigid foam plates 19 on exposed subgrade 37 and can be installed on existing mobile ballast cleaning machines without substantial structural changes in the machine. The vertical and lateral adjustability of this mechanism assures the accuracy of the plate positioning, particularly in track curves and at different ballast levels.

Figure 5:
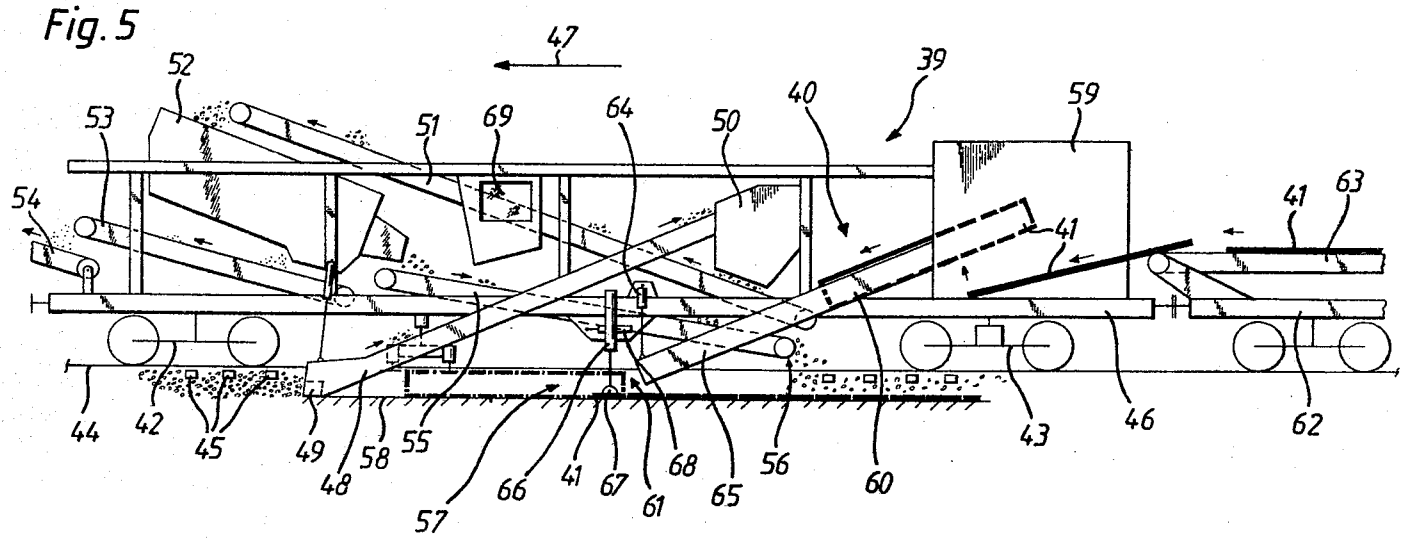
FIG. 5 is a larger side elevational view of another embodiment of the machine.

Mobile ballast cleaning machine 39, shown in FIG. 5, differs from machine 1 primarily with respect to the arrangement of the conveyor band means for carrying away the waste and for redistributing the cleaned ballast as well as the manner in which rigid foam plates 41 are delivered to plate handling apparatus 40. Machine 39 comprises frame 46 mounted on two swivel trucks 42, 43 for mobility along a track consisting of rails 44 fastened to ties 45 supported on ballast resting on subgrade 58. The machine advances in an operating direction indicated by arrow 47 and may be equipped with its own drive. The conventional ballast excavating means comprises endless ballast excavating chain 48 moving in a polygonal path circumscribing a space and transverse course 49 of the ballast excavating chain runs transversely under the track, hydraulic drives linking the chain to the frame for laterally and vertically positioning the chain. Observation cab 69 is arranged on the machine frame within the space circumscribed by the polygonal path of the ballast excavating chain. The ballast removed by the excavating chain is delivered to storage receptacle 50 whence ascending conveyor band 51 delivers ballast metered onto the conveyor band to ballast screening means 52 arranged on frame 46 to receive the removed ballast from ballast excavating means 48, 49 and to discharge cleaned ballast and waste. In addition, the machine comprises conveyor band means 53, 55 for carrying away waste and for redistributing the cleaned ballast, ballast redistributing conveyor band means 55 having a discharge end and zone 57 being defined between the ballast excavating means and the discharge end for laying a succession of rigid foam plates 41 on exposed subgrade 58. Conveyor band 53 delivers the waste from ballast screening means 52 to the front of the machine whence it is removed by discharge conveyor 54. Centrally positioned elongated conveyor band 55 receives the cleaned ballast from the ballast screening means and moves it to discharge end 56 whence it is distributed over plates 41 previously laid in zone 57 on exposed subgrade 58.

As in the previously described embodiment, plate handling apparatus 40 includes plate receiving and transfer station 59, elongated plate conveying path 60 extending from station 59 to zone 57 and plate turning and laying mechanism 61 preceding path 60 in the operating direction of the machine for receiving successive rigid foam plates 41 and for laying the successive plates in zone 57 under the track in a position extending transversely of the track.

In contrast to the previously described embodiment, the machine comprises at least one freight car 62 coupled to machine 39 for movement therewith along the track and for storing rigid foam plates 41, and elongated conveyor means 63 for conveying successive ones of stored plates 41 to receiving and transfer station 59. The plates delivered to station 59 by conveyor 63 are successively turned into a vertical position by preferably automatically operated gripping devices and are conveyed in this vertical position down guide chutes 60 in a manner similar to that described in connection with the embodiment of FIGS. 1 to 4. These chutes also have lower chute sections 65 pivotal about a horizontal axis to enable the exact point of deposition of the successive plates to be suitably adjusted, each plate being first set on exposed subgrade 58 in its vertical position, as shown in chain-dotted lines in FIG. 5, and then being tilted outwardly to lie on the subgrade outside the track. Suction head 67 of turning and laying mechanism 61 is then lowered by vertical drive 66 to engage the rear end of plate 41 lying on subgrade 58, the suction head is then slightly lifted to raise the plate end a little with the suction head gripping the plate end and pivoting drive 68 is operated to turn the section head and the plate gripped thereby by 90° so that the plate is laid accurately transversely to the track. The operation is readily monitored and controlled from cab 69 located above zone 57, and after the successive rigid foam plates have been laid in abutting relationship in zone 57, cleaned ballast is distributed thereover from discharge end 56 of conveyor 55.

The plate delivery system of this embodiment assures a fully automatic supply of rigid foam plates to the plate handling apparatus and thus enables it to function fully automatically since the plates are conveyed successively from the freight cars storing them in a conveying position extending in the direction of the machine so that the plates may be transferred at station 59 to conveying path 60 without substantial repositioning.

The operation of the mobile ballast cleaning machine of the present invention will be readily understood from the above description of the structure of certain now preferred embodiments thereof and will be further elucidated hereinafter in connection with the embodiment of FIGS. 1–4.

To provide a sufficient store of rigid foam plates 19, such a store of plates is loaded on freight car 15 before machine 1 is moved to the operating site or while the machine is moved thereto, for which purpose hoist 23 may be used to load the plates. At the operating site, the ballast excavating chain is positioned for the cleaning operation, with its transverse course 10 running under the track to remove the dirty ballast. Hoist 23 is operated to place a stack of rigid foam plates 19 on the bottom of receiving and transfer station 20. Successive plates are then inserted upright in at least one of the chutes 21 and, for a better understanding of the operation, the insulation of subgrade 37 from the subsequently redistributed cleaned ballast will be described in connection with the laying of one plate 19.

With respect to the operating direction indicated by arrow 7, a plate is delivered down the left-side guide chute 21 while the machine is advanced in the operating direction and ballast 36 under ties 5 is removed by excavating chain 9, 10 and is delivered to ballast screening means 12. When plate 19 arrives in the upright position from guide chute section 29 in zone 27 (indicated in FIG. 4 and in FIG. 1 by chain-dotted lines), it is tilted outwardly about one of its lower edges so that it lies flat on the exposed subgrade in zone 27 parallel to track rails 4 and laterally adjacent the track, as shown in chain-dotted lines in FIG. 2. Turning and laying mechanism 22 is now operated by actuating lateral adjusting drive 33 until vertical drive 31 at the left side of the machine frame is laterally aligned with plate 19, whereupon drive 31 is operated to lower suction head 32 into engagement with the rear end of the plate laying flat on the exposed subgrade. After the suction head has gripped the rear plate end, piston rod 34 is lifted just enough to raise the plate off the subgrade and pivoting drive 35 is actuated to turn the piston rod about its axis and to turn plate 19 by 90° in the direction of arrow 38 so that it assumes the transverse position shown in full lines in FIG. 2. The piston rod is then lowered to place the transversely positioned plate on the exposed subgrade under the track, the desired lateral positioning of plate 19 with respect to the track being obtained by operating lateral adjusting drive 33. After the rigid foam plate has thus been accurately laid, mechanism 22 is returned to its initial position to enable it to turn and lay the next plate 19 which, in the meantime, has been delivered down conveying path 21, the successive plates being laid on the subgrade in abutting relationship to provide a continuous insulating layer consisting of a succession of abutting rigid foam plates. Conveyor band means 14 is then operated to redistribute the cleaned ballast uniformly over this insulating layer.

In track sections subjected to considerable frost damage, it may be desirable to superimpose two layers of plates for proper insulation of the ballast bed from the subgrade, in which case successive plates 19 may be alternatingly delivered through both guide chutes 21. The laying of the lower insulating layer of plates is effected in the above-described manner and the right side of mechanism 22 is used in the same manner to lay plates 19 on top of the lower layer of plates but timed so that the upper layer of plates is staggered from the plates of the lower layer so that the upper plates cover the abutting edges of the lower plates. In this manner, no water can seep between the ballast and the subgrade.

The present invention is not limited to ballast cleaning machines of the illustrated type and may be advantageously used also in conjunction with mobile ballast cleaning machines equipped with separate devices for excavating the ballast and to receive and convey the removed ballast. Depending on the structure of the ballast cleaning machine, the plate conveying path and the plate turning and laying mechanism may be adapted in structure to the machine.

What is claimed is:

1. A mobile ballast cleaning machine comprising (a) a frame mounted on two undercarriages for mobility along a track supported on the ballast resting on a subgrade, (b) a ballast excavating means mounted on the frame between the two undercarriages for removing ballast from under the track to expose the subgrade, (c) a ballast screening means arranged on the frame to receive the removed ballast from the ballast excavating means and to discharge cleaned ballast and waste, (d) conveyor band means for carrying away the waste and for redistributing the cleaned ballast, the ballast redistributing conveyor band means having a discharge end and an exposed subgrade zone being defined between the ballast excavating means and the discharge end for laying a succession of rigid foam plates on the exposed subgrade, and (e) apparatus for handling the rigid foam plates, the apparatus including (1) a plate receiving and transfer station, (2) an elongted plate conveying path extending from the station to the zone for conveying successive ones of the plates in a direction substantially parallel to the track, and (3) a plate turning and laying mechanism in said zone receiving the successive rigid foam plates from the conveying path, for turning the plates and for laying the turned plates successively in said zone under the track in a position extending transversely to the track.

2. The ballast cleaning machine of claim 1, wherein the plate receiving and transfer station is arranged at a rear end of the frame and includes a plate gripping and hoisting device laterally displaceable with respect to the frame for receiving, gripping and hoisting rigid foam plates stored laterally adjacent the track.

3. The ballast cleaning machine of claim 1 or 2, wherein the elongated plate conveying path comprises an inclined chute having an inlet end receiving successive ones of the rigid foam plates from the receiving and transfer station, the chute being arranged laterally outside the frame for glidingly guiding the successive plates down to said zone.

4. The ballast cleaning machine of claim 1, wherein the plate turning and laying mechanism precedes the elongated plate conveying path in an operating direction of the machine and comprises a gripping element capable of gripping a respective one of the successive rigid foam plates received from the conveying path, the gripping element being pivotal about a vertical axis, and drive means for vertically and laterally adjusting the gripping element.

5. The ballast cleaning machine of claim 4, wherein the gripping element is a suction head.

6. The ballast cleaning machine of claim 1, further comprising an observation cab mounted on the frame above the turning and laying mechanism.

7. The ballast cleaning machine of claim 6, wherein the ballast excavating means comprises an endless ballast excavating chain moving in a polygonal path circumscribing a space and the observation cab is arranged within said space.

8. The ballast cleaning machine of claim 1, wherein the conveyor band means carrying away the waste extends through the receiving and transfer station to a rear end of the machine frame.

9. The ballast cleaning machine of claim 1, further comprising at least one freight car coupled to the machine frame for movement therewith along the track and for storing said rigid foam plates, and elongated conveyor means for conveying successive ones of the stored plates to the receiving and transfer station.

* * * * *